United States Patent [19]

Nguyen et al.

[11] Patent Number: 5,029,690

[45] Date of Patent: Jul. 9, 1991

[54] DECKING TRIM FASTENING FOR CURVED ESCALATOR

[75] Inventors: Dat Nguyen, New Britain; James A. Rivera, Bristol, both of Conn.; Willy Adrian, Obernkirchen; Joerg Rabing, Salzhemmendorf, both of Fed. Rep. of Germany

[73] Assignee: Otis Elevator Company, Farmington, Conn.

[21] Appl. No.: 580,236

[22] Filed: Sep. 10, 1990

[51] Int. Cl.[5] ..... B66B 23/22

[52] U.S. Cl. ..... 198/335

[58] Field of Search ..... 198/328, 335, 337, 338; 52/716, 733, 734, 287, 288

[56] References Cited

U.S. PATENT DOCUMENTS

| | | | |
|---|---|---|---|
| 1,956,153 | 4/1934 | Lindquist et al. | 198/335 X |
| 1,956,155 | 4/1934 | Lindquist et al. | 198/335 |
| 2,058,379 | 10/1936 | Handy et al. | 198/335 |
| 2,728,957 | 1/1956 | Keller | 52/288 |
| 3,180,642 | 4/1965 | Reineman | 52/784 X |
| 4,627,527 | 12/1986 | Saito | 198/335 |
| 4,646,907 | 3/1987 | Streibig et al. | 198/335 |
| 4,690,264 | 9/1987 | Adrian et al. | 198/335 |
| 4,889,222 | 12/1989 | Kanamori | 198/328 |

FOREIGN PATENT DOCUMENTS

| | | | |
|---|---|---|---|
| 0000584 | 1/1978 | Japan | 198/335 |
| 0016289 | 2/1978 | Japan | 198/335 |

*Primary Examiner*—D. Glenn Dayoan

*Attorney, Agent, or Firm*—William W. Jones

[57] ABSTRACT

The outer and inner side decks of a curved escalator are connected at its inner end to the balustrade, and includes a horizontal top panel which extends outwardly away from the balustrade, and outer vertical curved in plan side panel which extends downwardly from the outer edge of the top panel. These deck panels are secured to inner support components of the deck. The corner of the deck where the top and side panels meet is covered with a plastic trim molding which covers the screws fastening the side panel to the underlying supports, and which snaps onto catches which are hidden on the underside of the top panel. An attractive corner is thus formed free of unsightly screws, bolts, or other fasteners.

4 Claims, 4 Drawing Sheets

DECKING TRIM FASTENING FOR CURVED ESCALATOR

TECHNICAL FIELD

This invention relates to a curved escalator and more particularly to an attractive and streamlined decking for a curved escalator.

BACKGROUND ART

Curved escalators, i.e., escalators which follow a curved path of travel in plan, are known in the prior art. The inclusion of the curve in plan view renders details, both active and passive, of the escalator more complex than a linear escalator. Thus active components such as the drive chains, the steps, the drive sprockets, the handrail, and the like are not simple conversions of their linear escalator counterparts. Likewise, passive components of the escalator such as tracks, guide rails, balustrades and decks are also more complex than their linear escalator counterparts.

A very important aspect of the curved escalator is its aesthetic appearance. In fact, aesthetics is the single most desirable feature of a curved escalator. It is thus important to maximize the graceful lines of the curved escalator and minimize any distractions therefrom. The curved escalator will most frequently be installed in large open areas so as to accommodate its shape, and maximize the pleasure of riding on it. This being the case, the sides of the escalator will not abut vertical walls as in most linear escalators, but rather will be highly visible. The curved escalator will thus be formed with inner and outer decks which extend outwardly and downwardly away from the balustrades. These decks will form part of a housing on the escalator which hides the return path of the escalator steps. It is important to make the decks and the rest of the housing as light in weight as possible since the curved escalator, for any rise, is inherently larger than a linear escalator. The use of lightweight sheet metal for the decking and housing is thus desirable. Sheet metal must be fastened to the underlying support structure with sheet metal screws which detract from the lines of the escalator. U.S. Pat. No. 4.889,222 granted Dec. 26, 1989 to O. Kanamori discloses such a balustrade and decking structure for a curved escalator. It would be desirable therefore to hide such fastening screws from sight.

DISCLOSURE OF THE INVENTION

This invention relates to a curved escalator deck assembly which includes a lightweight sheet metal skin fastened to an underlying support structure by a plurality of sheet metal screws disposed at the corner of the top and side panels of the deck. The underside of the top panel of the deck is provided with protuberances which are adjacent to the outer edge of the top panel. The protuberances are preferably in the form of washers tack welded to the panel, but could also be a rib or the like formed on the panel. A plastic corner trim strip with gripping jaws on one leg is mounted on the outer edge of the top panel, the gripping jaws being operable to latch onto the washers. The trim strip also includes a downwardly depending skirt which overlies all of the screw heads which fasten the side panel to the underlying supports. The trim panel will preferably be made from a flexible plastic such as PVC, and has a profile which lends itself to being extruded.

It is therefore an object of this invention to provide an improved, aesthetically pleasing curved escalator assembly.

It is another object of this invention to provide a curved escalator assembly of the character described which has side decks flanking the stairway and balustrades.

It is an additional object of this invention to provide a curved escalator assembly of the character described wherein the side decks are formed from sheet metal and are devoid of visible sheet metal screws or the like fasteners.

These and other objects and advantages of the invention will become more readily apparent from the following detailed description of a preferred embodiment thereof when taken in conjunction with the accompanying drawings, in which:

Best Mode for Carrying Out the Invention

Figure 1:
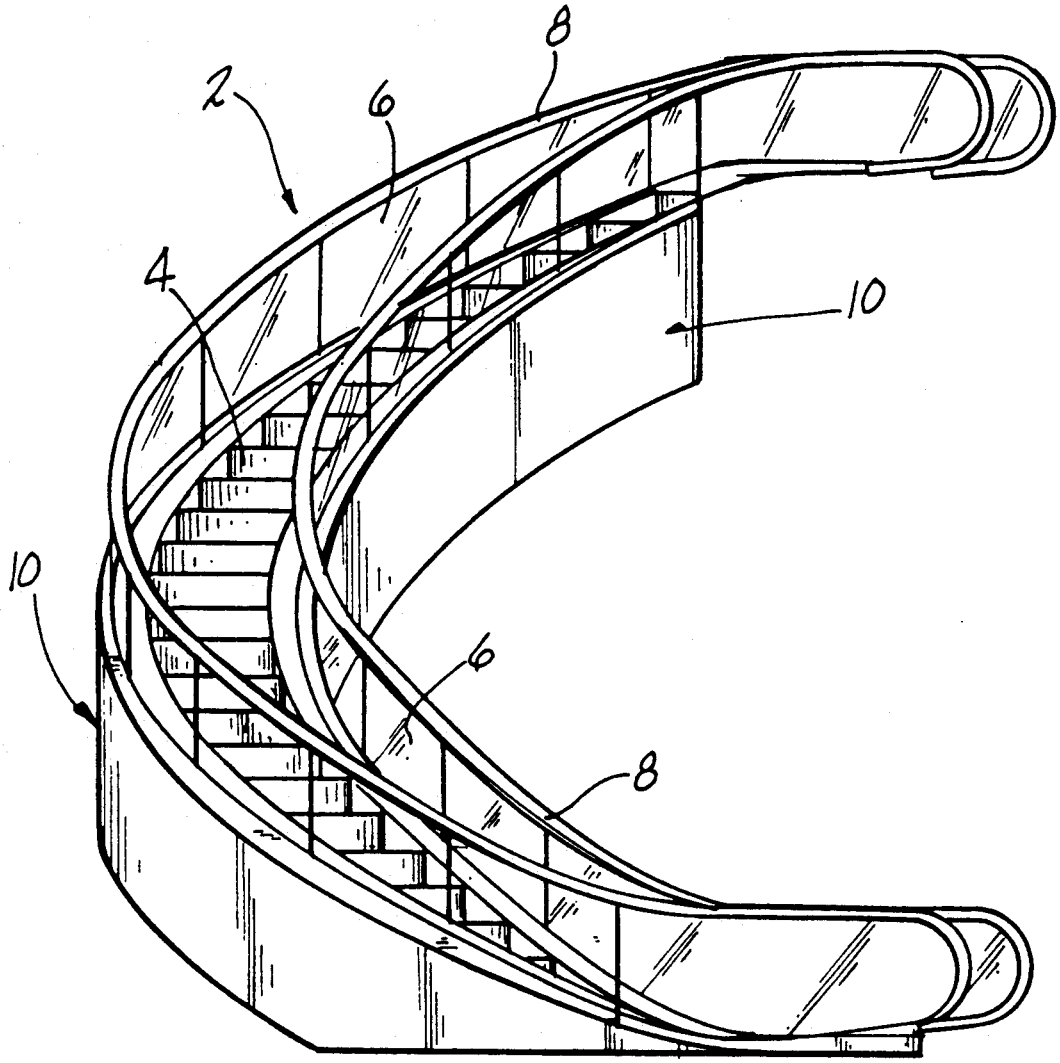
FIG. 1 is a perspective view of a curved escalator having side decks formed in accordance with the invention.

Referring now to the drawings there is shown in FIG. 1 a curved escalator denoted generally by the numeral 2 which includes a train of moving steps 4, balustrades 6 over which handrails 8 move, and inner and outer decks 10 which lie inboard and outboard of the balustrades 6.

Figure 2:
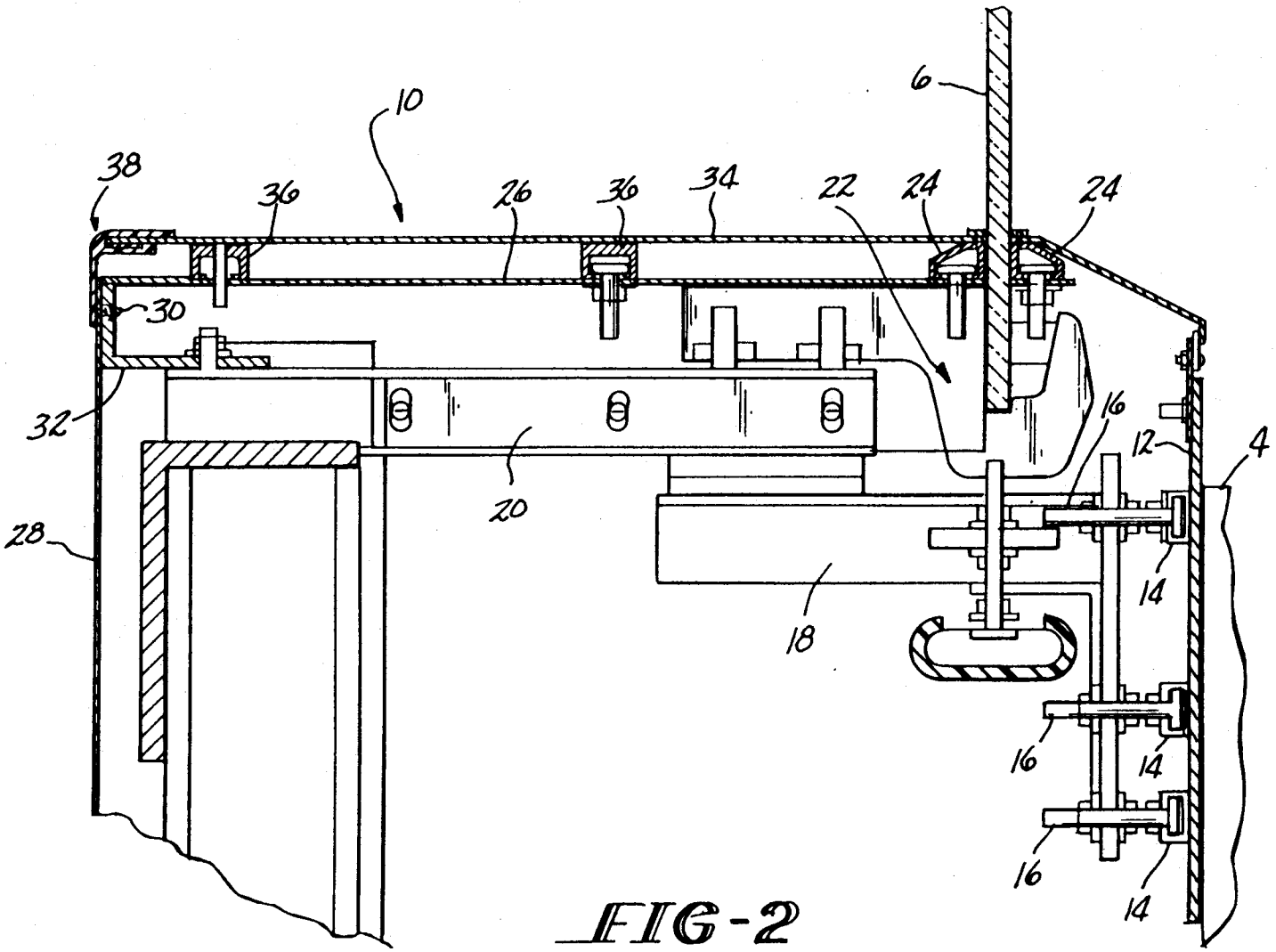
FIG. 2 is a vertical transverse sectional view of the outer side deck of the escalator of FIG. 1.
Figure 3:
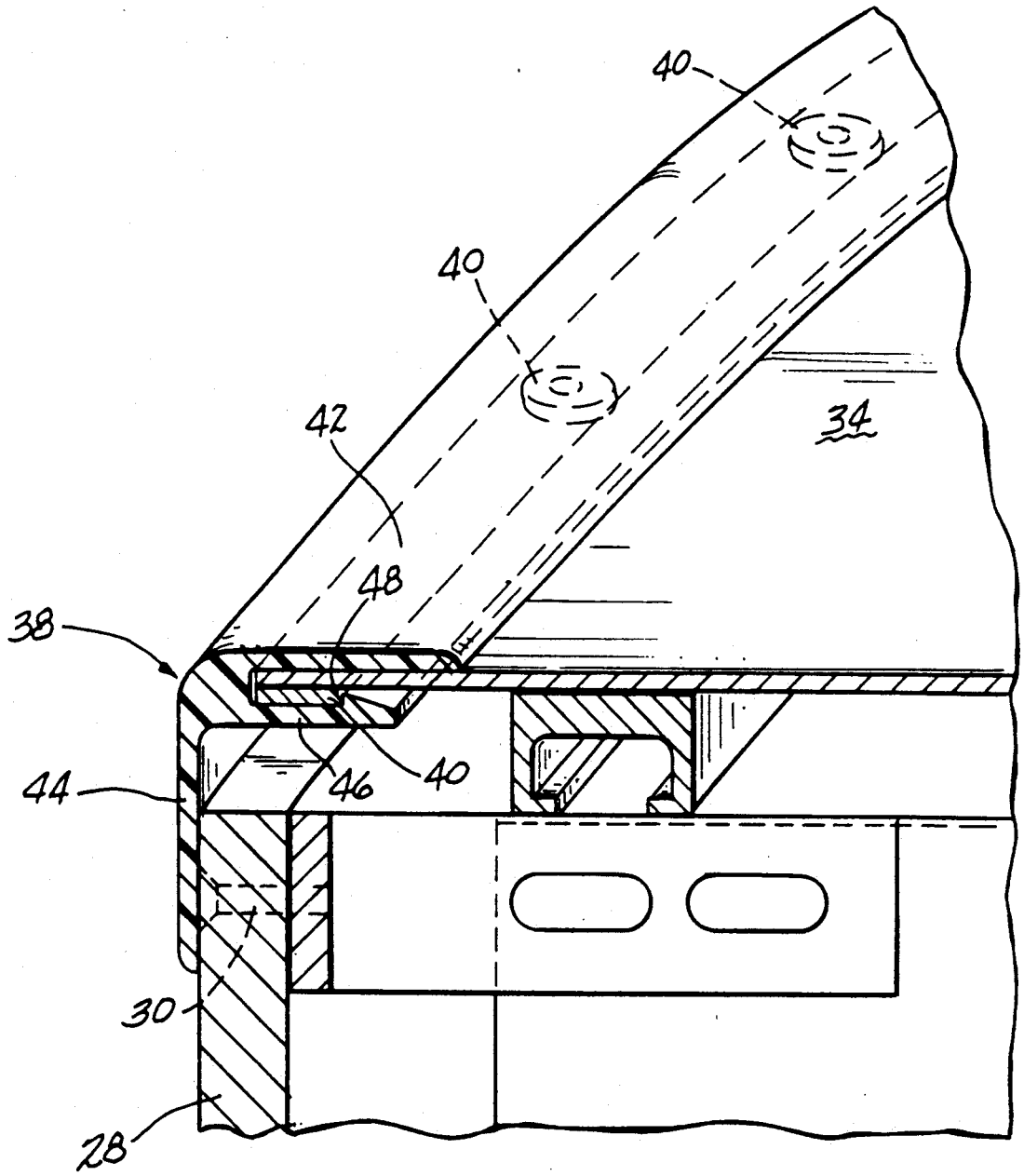
FIG. 3 is an enlarged perspective sectional view similar to FIG. 2 showing the placement of the tack welded washers on the underside of the top panel of the deck.

FIGS. 2 and 3 show details of the side decks 10, and what lies within the side decks. Skirt panels 12 flank the steps 4, and carry a plurality of brackets 14 on which are mounted bolts 16. The bolts 16 support a mounting plate 18 to which lateral beams 20 are secured. The beams 20 and plate 18 are used to position balustrade mounting assemblies 22 inside of the deck 10. A pair of balustrade supports 24 straddle the balustrade 6 on the mounting assemblies 22. A bracket 26 sandwiched between the mounting assembly 22 and balustrade supports 24 extends outwardly to the side panel 28. The side panel 28 is a sheet metal panel which has its upper end attached by screws 30 to angle brackets 32 bolted to the beams 20. A deck top panel 34 is mounted on the balustrade supports 24 and extends outwardly therefrom toward the deck side panel 28. The top panel 34 is also a sheet metal panel which is supported on the bracket 26 by spacers 36 bolted to the bracket 26. It will be noted that the top panel 34 is upwardly spaced apart from, and radially inwardly spaced from the side panel 28. The plastic trim strip 38 is clipped onto the outer edge of the top panel 34 and extends downwardly outboard of the side panel 28.

Referring to FIG. 3, details of the trim strip 38 and its manner of affixation to the top panel 34 are shown. A plurality of washers 40 are tack welded to the underside of the top panel 34 at its outer edge to form grippable protrusions on the top panel 34. The trim strip 38 has an upper flap 42 which overlies the outer margin of the top panel 34, and a side skirt 44 which abuts the upper margin of the side panel 28. The skirt 44 extends downwardly for a distance sufficient to cover the sheet metal screws 30 which hold the side panel 28 in place. A latching finger 46 is formed integrally on the trim strip 38 and includes a hook 48 which engages the inner sides of the washers 40. The upper flap 42 and latching finger 46 with its hook 48 thus form a resilient clamp which fastens onto the outer edge of the top panel 34 to hold the trim strip 38 in place. The strip 38 is preferably made from a resilient plastic such as PVC, and may be appropriately colored to accent the deck, or to blend in with the rest of the sheet metal components.

Figure 4:
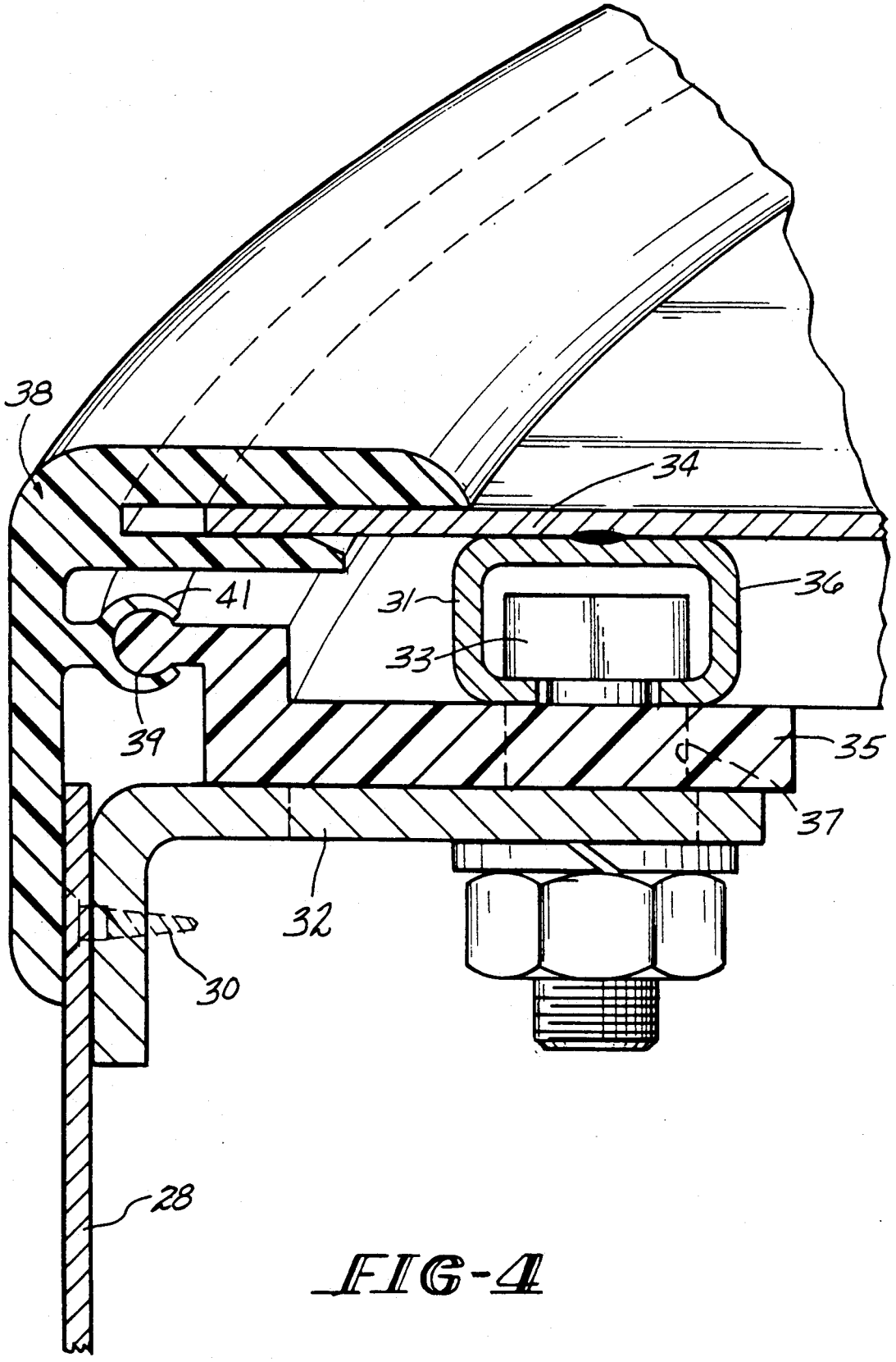
FIG. 4 is a view similar to FIG. 3 but showing an auxiliary connection between the trim strip and top panel.

Referring to FIG. 4, there is shown an alternative embodiment of the invention wherein auxiliary connections are made between the trim strip 38 and the top plate 34. In this embodiment a channel bracket 31 is tack welded to the undersurface of the top panel 34. Bolts 33 are serially mounted to the bracket 31 passing through an extruded plastic clip 35 and the angle bracket 32. The clip 35 has a through bore 37 which receives the bolts 33, and a bead 39 which snap fits into a channel 41 formed on the inner side of the trim strip 38. In this manner a connection auxiliary to the screws 30 is made between the angle bracket 32 and trim strip 38. Likewise, the connection between the top panel 34 and the trim strip 38 is strengthened. The plastic clip 35 can be axially elongated so as to inwardly flank the trim strip 38 throughout substantially its entire length, or there can be a plurality of shorter serially positioned clips 35 used.

It will be readily appreciated that the assembly of this invention provides an aesthetically pleasing appearance to the escalator with minimum complexity. The trim strip can be extruded and can be easily fitted onto the curved decks of the escalator due to its flexibility. The washers tack welded onto the sheet metal panel provide an effective and simple securement which can be customized on the job site.

Since many changes and variations of the disclosed embodiment of the invention may be made without departing from the inventive concept, it is not intended to limit the invention otherwise than as required by the appended claims.

What is claimed is:

1. In an escalator assembly having a moving treadway portion flanked by a pair of balustrades, an outer decking assembly flanking said balustrades and comprising:

a) a top deck plate extending outwardly of each balustrade and away from said treadway;

b) a vertical outer side deck plate terminating below and outwardly of said top deck plate whereby a gap exists between adjacent edges of said top and side deck plates;

c) a substructure underlying said top and side deck plates and connected to a truss on the escalator, said substructure providing support for the top and side deck plates; and d) a plastic trim strip spanning said gap and overlying respective outer edge portions of said top and side deck plates, said trim strip having a recess with upper and lower arms flanking the recess, said recess being open to telescopingly receiving an edge of said top deck plate, and said recess having a locking projection on one of said arms for locking engagement with complimentary projecting means on an undersurface of said top deck plate edge.

2. The escalator assembly of claim 1 wherein said side deck plate is secured in said substructure by a plurality of fasteners, and said trim strip is operable to cover said fasteners to hide the latter from view.

3. The escalator assembly of claim 1 wherein said complimentary projecting means comprises a plurality of washers tack welded to said top deck plate.

4. The escalator assembly of claim 1 wherein said substructure comprises a plastic strip having a locking bead formed thereon facing said side deck plate, and said trim strip is formed with a recessed locking cup complementary to said locking bead, and said trim strip is snap fitted onto said locking bead.

* * * * *